US009095992B2

(12) United States Patent
Reuterberg et al.

(10) Patent No.: US 9,095,992 B2
(45) Date of Patent: Aug. 4, 2015

(54) PORTABLE WATER TANK ASSEMBLY FOR A DUST EMITTING CONSTRUCTION MACHINE

(75) Inventors: Anders Reuterberg, Lerum (SE); Hans Petersson, Göteborg (SE)

(73) Assignee: HUSQVARNA AB, Huskvarna (SE)

( * ) Notice: Subject to any disclaimer, the term of this patent is extended or adjusted under 35 U.S.C. 154(b) by 963 days.

(21) Appl. No.: 13/139,183

(22) PCT Filed: Dec. 12, 2008

(86) PCT No.: PCT/SE2008/000698

§ 371 (c)(1),
(2), (4) Date: Jun. 10, 2011

(87) PCT Pub. No.: WO2010/068148

PCT Pub. Date: Jun. 17, 2010

(65) Prior Publication Data

US 2011/0247708 A1 Oct. 13, 2011

(51) Int. Cl.
*B28D 7/02* (2006.01)

(52) U.S. Cl.
CPC ..... *B28D 7/02* (2013.01)

(58) Field of Classification Search
CPC ..... B28D 7/02
USPC ..... 137/565.17; 451/449, 450; 222/175, 222/333, 383.1, 383.2, 383.3, 385; 239/152
See application file for complete search history.

(56) References Cited

U.S. PATENT DOCUMENTS 3,726,443 A * 4/1973 Harris ..... 222/333
4,135,647 A * 1/1979 Mascia et al. ..... 222/211
4,801,088 A * 1/1989 Baker ..... 239/152
5,477,881 A * 12/1995 Fujinaka et al. ..... 137/565.17
6,450,869 B1 * 9/2002 Sherez ..... 451/449
6,478,666 B1 * 11/2002 Berger et al. ..... 451/344

(Continued)

FOREIGN PATENT DOCUMENTS

WO 0168300 A1 9/2001
WO 2004098849 A1 11/2004

OTHER PUBLICATIONS

International Search Report, Aug. 6, 2009, pp. 1-3.

(Continued)

*Primary Examiner* — Craig Schneider
*Assistant Examiner* — Nicole Wentlandt
(74) *Attorney, Agent, or Firm* — Nelson Mullins Riley & Scarborough LLP

(57) ABSTRACT

A portable water tank assembly for a dust emitting construction machine, such as a machine for cutting concrete, stone, ceramic materials and the like, said assembly comprising a water container (1) and an electric pump (2) powered by a battery for pumping water from the container (1) through an outlet to the construction machine. To provide a portable water tank assembly which provides a long service life without changing battery, is easy to handle and carry and that is robust and reliable, the pump is a low pressure pump (2), of 0.1-1.5 bar, preferably of 0.3-1.2 bar, that is preferably submersible and placed inside the water container (1); and said assembly has at least 5 liter capacity. Preferably the hood member (3) has a first compartment (5) for a battery for delivering power to the pump (2) and a battery (6) located in the compartment (5), and it may have a second compartment (11) for a battery charger (12) and a third compartment (13) for a spare battery.

19 Claims, 4 Drawing Sheets

(56) References Cited

U.S. PATENT DOCUMENTS

| | | | | |
|---|---|---|---|---|
| 7,007,826 | B2 * | 3/2006 | Shapanus et al. | 222/175 |
| 7,080,851 | B2 * | 7/2006 | Schipper | 451/344 |
| 7,311,100 | B1 * | 12/2007 | Siewers | 451/450 |
| 7,905,223 | B2 * | 3/2011 | von Siegroth et al. | 125/13.01 |
| 7,967,391 | B1 * | 6/2011 | Dalley | 299/39.3 |
| 2006/0240753 | A1 * | 10/2006 | Ziegs | 451/449 |
| 2007/0246583 | A1 | 10/2007 | Gorenflo | |
| 2009/0173753 | A1 * | 7/2009 | Conner et al. | 222/333 |

OTHER PUBLICATIONS

International Preliminary Report on Patentability, Mar. 10, 2011, pp. 1-6.

* cited by examiner

PORTABLE WATER TANK ASSEMBLY FOR A DUST EMITTING CONSTRUCTION MACHINE

TECHNICAL FIELD

The present invention relates to a portable water tank assembly for a dust emitting construction machine, such as a machine for cutting concrete, stone, ceramic materials and the like, said assembly comprising a water container and an electric pump powered by a battery for pumping water from the container through an outlet to the construction machine.

The term "cutting" also includes the operation carried out on a material by a rotating drill.

The term "electric pump" designates an assembly including the proper pump and an electric motor for driving the pump.

The term "low voltage" relates to electric components of Class III, i.e. extra low voltage, up to 42 V.

BACKGROUND ART

When performing cutting operations on materials like concrete, stone, and ceramics, dust is generated. This dust dirties the work area, can make it difficult to see the area being cut, and it could in special cases even be dangerous to inhale the dust in view of the risk of developing silicosis. Even the use of a mask is generally not sufficient to prevent the inhalation of the dust. Therefore, it has been suggested to direct a fog-like flow of water droplets against the working area for moistening dust particles that are generated during cutting, so as to reduce the quantity of dust. An example of a spray tool is a spray lid with integrated battery/batteries to be arranged on top of a standard 5 gallon cylindrical bucket. It is supplied by SMK Industries. To suck the liquid up from below a self priming pump of membrane type is used having a pressure of 1.8-2.8 bar. This type of pump requires a lot of energy and will therefore drain battery/ies quickly, thereby requiring frequent exchange of battery/ies. Further it is sensitive to particles/dirt in the fluid, that could easily clog the pump, especially its checkvalves.

It has been suggested to use a water tank, in which the pressure is pumped up manually, vide catalog 2008—Husqvarna Construction Products, p. 185, for example. Such a tank may be in the shape of an upright cylinder and usually is heavy and easy to turn over, so that the discharge hose will provide pressurized air instead of water. In addition, the manual pressurization of the tank will result in a quick reduction of the pressure and flow as the water level goes down. Therefore you must pump often, which interrupts your work.

Another suggestion is disclosed in U.S. Pat. No. 6,450,869 B1, which relates to an attachment for a hand cutting tool having at least one rotating blade. The attachment includes a portable device attachable to the hand cutting tool for producing a fog-like spray of water droplets near the rotating blade for moistening dust particles generated during cutting. Preferably, the attachment includes a portable source of pressurized water which can be carried like a back-pack on the body of a user holding the cutting tool, and at least one nozzle mounted in the blade guard and coupled to the source of pressurized water for producing a fog-like spray of water droplets. The source of pressurized water includes a small water container coupled to a pressurizing pump, which preferably should give a pressure of 260 kPa to achieve the desired fog-like spray of fine droplets, and which may be mounted in an electrical box that also includes an earth leakage switch. A voltage of 220 V is fed through the earth leakage switch to the machine and through its on/off-switch back to the pump. The combination inside a box of 220 V and a water pump may make a user feel unsafe, and in construction sites, 200 V is not always available, apart from often being time consuming to connect to the mains supply.

In US 2007/0246583 A1 there is disclosed a cutting device arrangement including a generator and a spray device in the region of a cutting tool, whereby liquid is sprayed for binding cutting residue blown up during the cutting process. The generator is driven by the engine of the device. The cutting device also includes a liquid supply device, such as a water tank or container, by means of which the liquid can be supplied to the spray device. An electric pump is provided as part of the spray device, so that the liquid can be sprayed under pressure, and the electric pump is operatively connected to the generator. The pump may be mounted to the bottom end of the tank, or in a hose from the tank to the cutting device, or even be integrated in the cutting device. In the first case, the pump is damaged easily due to its exposed location. In the second case both the pump and the electrical connection to the generator are susceptible to damage, and in the third case, the pump is protected, but the solution is expensive, since each device has to have a pump of its own.

DISCLOSURE OF THE INVENTION

The object of the present invention is to provide a portable water tank assembly, which provides a long time of water flow without pumping or switching battery, and further is easy to handle and carry apart from being robust and reliable.

This object is achieved in a portable water tank assembly of the kind stated in the first paragraph above in accordance with the present invention in that the pump is a low pressure pump, of 0.1-1.5 bar, preferably of 0.3-1.2 bar, that is preferably placed inside the water container; and said assembly has at least 5 liter capacity. The use of a low pressure pump makes it possible to consume little energy, so that battery/ies last much longer avoiding frequent exchange. The preferred use of a battery powered submersible pump placed inside the water container makes it possible to utilize an inexpensive pump placed in the water container preferably made of a suitable plastics materiel and shape, while the battery is housed in a hood member isolated from the water and made of another suitable plastics material. A submersible pump is cooled by the water and is of a compact design. The water tank assembly preferably further comprises a hood member, which is attached to the water container and preferably includes a handle for carrying the water tank assembly, said hood member having a first compartment for a battery for delivering power to the pump and preferably a battery located in the compartment.

The battery preferably is a Li-ion battery package, having a nominal voltage on the order of 18.5 V and a capacity of 1.6 Ah.

For charging the battery, the hood member preferably has a second compartment for a battery charger, and a battery charger is preferably located therein. With the battery charger located in the hood member, it is better protected against possible damage in a construction site, for example, than if it was a separate unit to be connected to the battery.

Then it is suitable that the hood member also has a third compartment for a spare battery, and a spare battery is preferably located therein. The spare battery and the battery loader may be taken out of the hood member and connected to a power source for loading the spare battery while running the water tank assembly on its ordinary battery.

Preferably the hood member has a fourth compartment for an electronic circuit board for controlling at least the voltage to the pump, so that there will be a constant provision of preferably 12 V to the pump, and such an electronic circuit board is located therein.

Then it is suitable that the electronic circuit board includes a voltage monitor for protecting the battery by avoiding the voltage falling below a predetermined level, preferably 12 V for a Li-ion battery package having a nominal voltage on the order of 18.5 V.

It is also suitable that the electronic circuit board includes a timer function for avoiding discharging the battery by mistake.

To indicate the electric charge status of the battery, it is recommendable that the hood member has an external light emitting diode. It is also recommendable that the hood member has a power switch located on the handle for starting and stopping the pump.

Preferably, the portable water tank assembly further comprises a foot member attached to a bottom portion of the water container, and the water container may have a bottom flange, around which the foot member is attached. The foot member protects the water container from wear, especially at its bottom and corners.

The bottom portion and the foot member suitably define a recessed annular space for housing a coiled hose, which in an uncoiled state is intended to connect the water tank assembly to the construction machine. This gives impact protection and with a low connection point for the hose, the knock-over risk is minimized.

The hose has a free end, which suitably is provided with a connector having an integrated stop valve, and the hood member has a holder for the free end of the hose. The connector facilitates the connection of the hose to the dust emitting construction machine, and the integrated stop valve automatically stops the flow of water through the hose upon disconnection of the hose from the machine. The holder prevents a coiled hose in the annular space from uncoiling and gives easy access to the free end of the hose when it is to be connected to a machine.

The low pressure submersible pump suitably is a non self priming pump located close to the bottom of the water container, inside or outside the water container. Hereby energy can be saved. Preferably the pump is a centrifugal pump, that is comparatively insensitive to particles of sand, for example. It does not need checkvalves and can have a radially contact free pump wheel. All this reduces energy and the risk of clogging.

It is recommendable that the water container has a volume of at most 17 liters, preferably on the order of 10 liters. Thereby a filled container will last up to 2 h and the water tank assembly full tank will have a maximum weight of at most 20 kg, preferably on the order of 14 kg and will still be easy to carry from one place to another.

BRIEF DESCRIPTION OF THE DRAWINGS

In the following, the invention will be described in more detail with reference to preferred embodiments and the appended drawings.

MODE(S) FOR CARRYING OUT THE INVENTION

Figure 1:
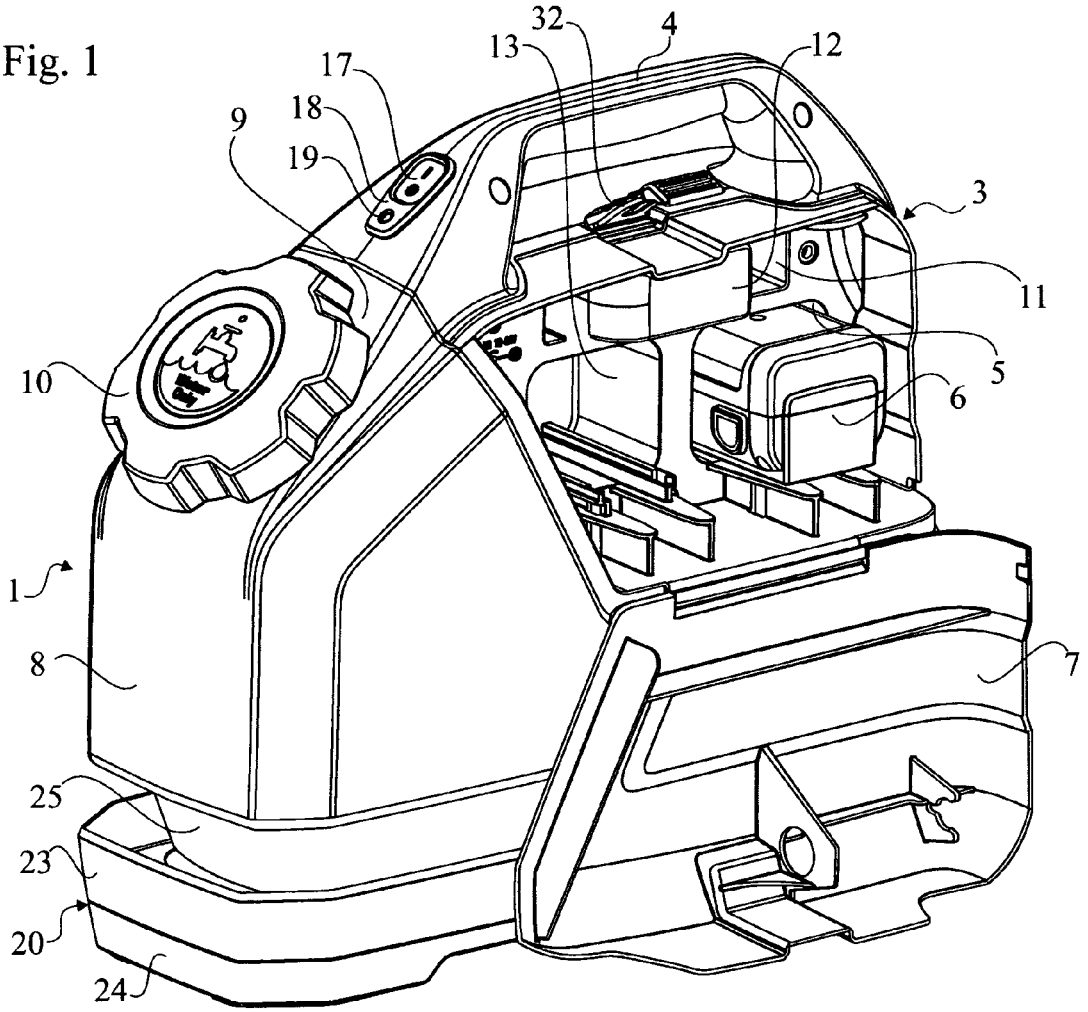
FIG. 1 is a perspective view of a portable water tank assembly in accordance with a preferred embodiment of the present invention including a water container and a hood member having a side door shown in an open position to expose a battery package and a battery charger.

The portable water tank assembly illustrated in the drawings comprises a water container 1 and an electric pump for pumping water from the container through an outlet to a construction machine, not shown.

In accordance with the present invention the pump is a low voltage submersible pump 2 that is placed inside the water container 1. A suitable pump is a 12 V centrifugal pump from the ECO series of Comet-Pumpen Systemtechnik GmbH & Co. KG in Germany. Such a pump is insensitive to sand and similar particles, has a life of more than 300 h, is often cooled by the water, is of a compact design, has a low power consumption, can endure dry-running for 2 h, will give a pressure of 0.7 bar, and is simple to clean or exchange at service.

Further, in accordance with the present invention, the portable water tank assembly comprises a moisture-proof hood member 3, which is attached to the water container 1 and includes a handle 4 for carrying the water tank assembly, and the hood member 3 has a first compartment 5 for a battery for delivering power to the pump 2 and a battery 6 located in the compartment 5.

As shown in FIG. 1, the hood member 3 has a side door 7 that is hinged at the door bottom and shown in an open position to expose the battery 6 placed in the first compartment 5. To keep the side door 7 in position when closed, a snap-clip 32 is provided under the handle 4.

The water container 1 has a lower substantially brick-shaped portion 8 far containing a main portion of the water in the container, and a converging top portion 9 extending upwards from the bottom portion. On a front side of the top portion 9 and close to the top thereof, a large area filler cap 10 is provided. The opening closed by the filler cap 10 is sufficiently large to permit the insertion of the pump 2 into and the mounting thereof within the lower portion 8 of the water container 1. The pump 2 is preferably standing on the bottom of the water container 1 and is fixed thereto by a screw, clips, rivets not shown, or possibly by glueing. The low pressure pump is a centrifugal pump (6) located in a position close to the bottom of the water container (1), inside or outside the water container.

At its top end, the pump 2 has an outlet for pressurized water, and a short hose, not shown, has one end attached to the outlet. The other end of the short hose is connected to a two-piece nipple, not shown, extending through a side wall of the water container 1. On a top surface of the lower container portion 8 and preferably also on the rear side of the top portion 9, there is provided an upwards extending flange, not shown, for mounting the hood member 3, which preferably is made as a right-hand half and a left-hand half, to the water container 1, e.g. by screwing. The flange could either be solid with screw holes passing through or could have a thicker outer part around which the two halves of the hood member are clamped.

In the preferred embodiment shown in the drawings, the hood member 3 also has a second compartment 11 for a battery charger 12 and a third compartment 13 for a spare battery, not shown. The battery charger 12 and the spare battery are not electrically connected to battery 6. When the spare battery is to be charged, the battery charger 12 and the spare battery is taken out of the hood member 3, and then they are interconnected by a cable, not shown, and the battery charger 12 is connected by a power cord, not shown, to the distribution circuits of an electrical power source via a wall socket or extension cord, for example, not shown. Thereby, the work with the construction machine that receives water from the portable water tank assembly can continue without any risk of a short circuit during the charging of the spare battery.

Further, the battery is a Li-ion battery package 6, preferably having a nominal voltage on the order of 18.5 V and a capacity of 1.6 Ah. For controlling the operation of the pump 2, an electronic circuit board is included in the water tank assembly. The circuit board is located in a fourth compartment, not shown, in the hood member 3. This fourth compartment is not available through the side door 7, but has a location protected from moisture on the opposite side of the hood member 3. The circuit board is connected to the battery 6, but may also have a connection for external power supply. The circuit board includes a voltage controller that controls the voltage to the pump 2, so that there will be a constant provision of 12 V to the pump 2. Further, the electronic circuit board includes a voltage monitor for protecting the battery package 6 by avoiding the voltage falling below a predetermined level, preferably 12 V for a Li-ion battery package having a nominal voltage on the order of 18.5 V. It is also recommendable that the circuit board includes a timer for avoiding discharging the battery package 6 by mistake. The timer starts automatically on starting the pump 2, and if the pump has not been switched off after a predetermined time, half an hour, for example, the timer switches off the pump. In the preferred embodiment, the water container 1 will have been used at that time, so that the container needs refilling. A power switch 17 is connected to the circuit board for turning on/off the power from the battery package 6 to the pump 2. The power switch 17 is provided in a wall entrance 18 in the handle 4 at a position not for from the filler cap 10. A light emitting diode 19 of a kind that blinks when the pump 2 is operating is also connected to the circuit board and is located the wall entrance 18 adjacent to the power switch 17. Preferably, the light from the diode 19 changes from green over yellow to red to indicate the electric charge status, i.e. the remaining charge in the battery package 6. A lead, not shown, from the circuit board to the pump 2, passes into the water container 1 at the very top of the container top portion 9.

Figure 2:
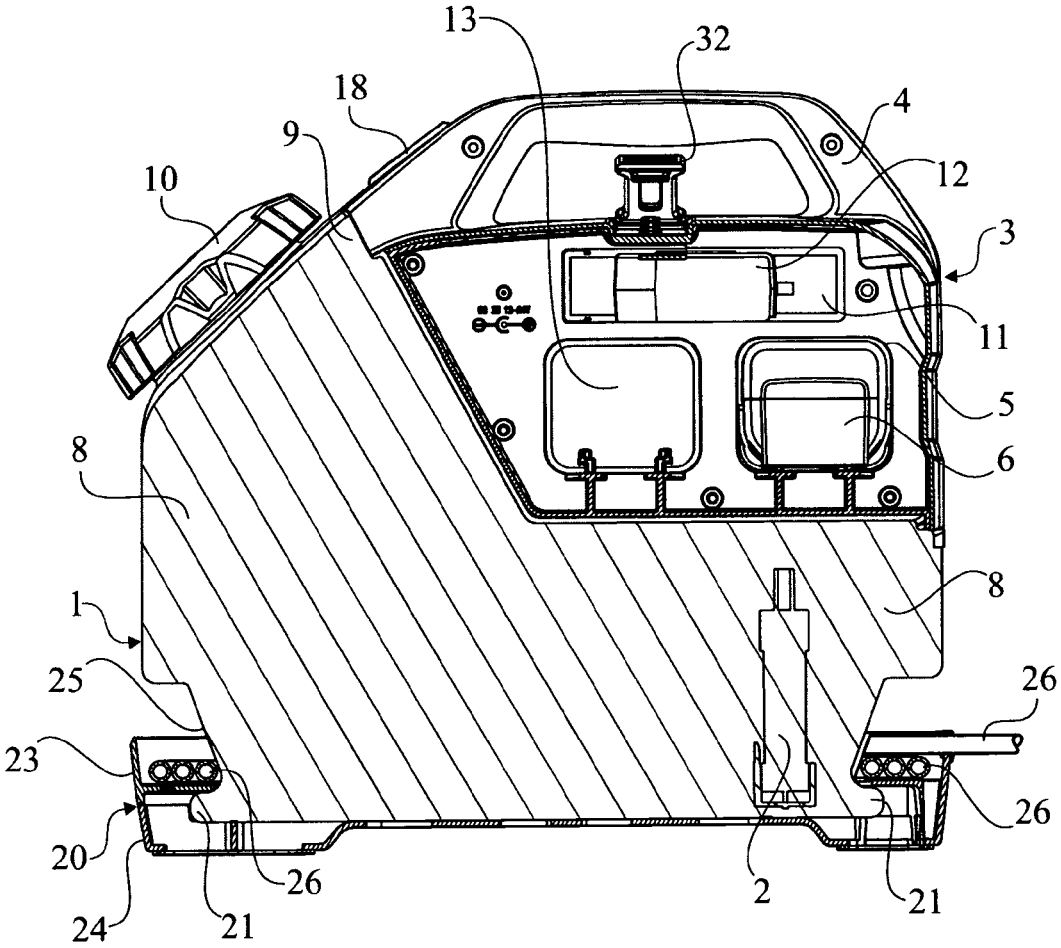
FIG. 2 is a vertical cross-sectional view of the water tank assembly of FIG. 1, where a submersible pump is located in the water container.
Figure 3:
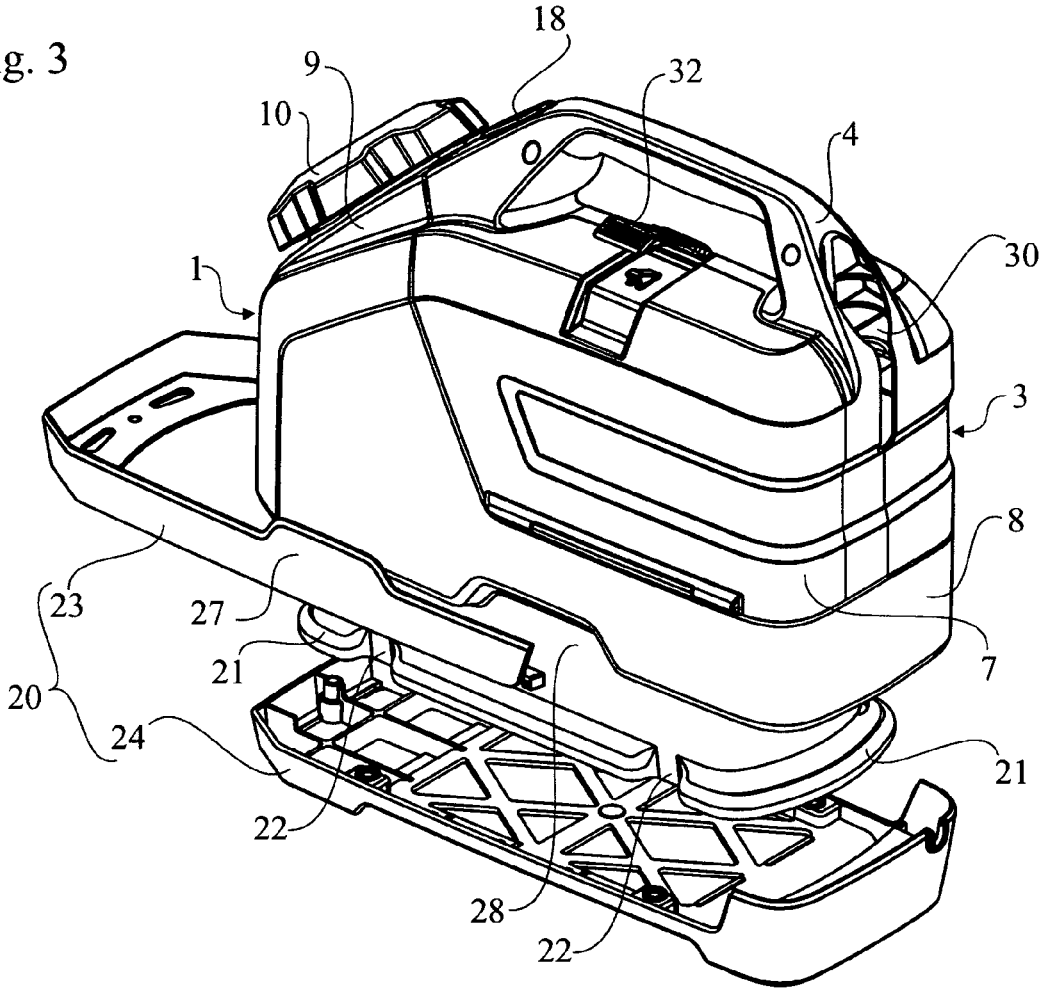
FIG. 3 is a partially exploded perspective view of the water tank assembly of FIG. 1 but viewed from another direction and illustrating inter alia a two-part foot member to be attached to a bottom portion of the water container.

In the shown preferred embodiment, a foot member 20 is attached to a bottom portion of the water container 1. As is best shown in FIGS. 2 and 3, the water container 1 has a bottom flange 21, around which the foot member 20 is attached. Around its periphery, the bottom flange 21 is provided with a series of recesses 22. The foot member 20 includes an upper U-shaped member 23 and a foot bottom 24 provided with suitable bores for being attached to each other by means of screws, not shown, extending through the recesses of the container bottom flange 21. As shown in FIG. 3, the foot bottom 24 is in the shape of a grating to let water pass through if spilled out during refilling of the water container 1.

Figure 4:
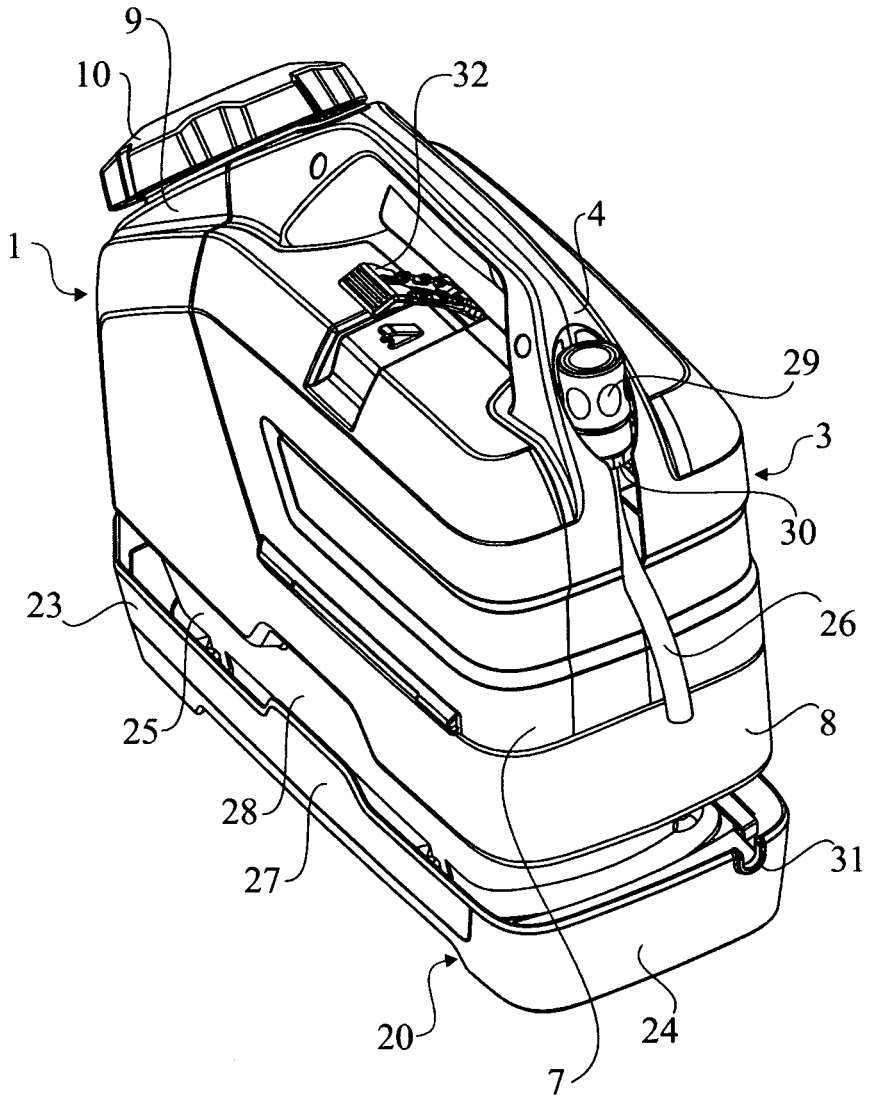
FIG. 4 is a perspective view of the water tank assembly of FIG. 1 but viewed from its rear end and showing among other things a water hose with free end provided with a connector placed in a holder for the hose.

The container bottom portion and the foot member 20 define a recessed annular space 25 for housing a coiled hose 26, which in an uncoiled state is intended to connect the water tank assembly to the construction machine. To assist in retaining the coiled hose 26 in the recessed annular space 25, about halfway along each longitudinal side of the water container 1 the U-shaped member 23 has an upward extending fin 27 and there is a corresponding recess 28 in the water container 1 in order to maintain the width of the recessed annular space 25 substantially constant to facilitate the intentional coiling and uncoiling of the hose 26. One end of the hose 26 is connected to the two-piece nipple, not shown, and the other end is free and provided with a connector 29 having an integrated stop valve. As best shown in FIGS. 3 and 4, at the rear end of the handle 4, the hood member 3 has a recessed holder 30 for the free end of the hose 26 with its connector 29. An upper edge of the foot member 20 is provided with a U-shaped recess 31 of a width that is slightly smaller than the external diameter of the hose 26, so that the hose when fully or partly uncoiled can be pinched therein.

The water container 1 suitably has a volume of at most 17 liters, preferably on the order of 10 liters. With full tank, the portable water tank assembly of the invention should have a maximum weight of at most 20 kg, preferably on the order of 14 kg to be easy to handle for a user.

Although only one preferred specific embodiment is described above and shown in the drawings, it is obvious that a worker skilled in the art easily will realize how to vary the inventive concept within the terms of the appended claims.

INDUSTRIAL APPLICABILITY

The portable water tank assembly of the present invention is intended to be connected via a hose to a dust emitting construction machine, such as a machine for cutting concrete, stone, ceramic materials and the like in order to bind the emitted dust with water. It is especially suitable where a connection to an ordinary mains power system is not readily available.

The invention claimed is:

1. A portable water tank assembly for a dust emitting construction machine, said assembly comprising a water container and an electric pump powered by a battery for pumping water from the container through an outlet to the construction machine, the pump is a low pressure pump of 0.1-1.5 bar; and said assembly has at least 5 liter capacity.

2. The portable water tank assembly as claimed in claim 1, wherein said hood member is at least partly openable.

3. The portable water tank assembly as claimed in claim 1, wherein said hood member has a first compartment for a battery for delivering power to the pump, and preferably a battery is located in the first compartment.

4. The portable water tank assembly as claimed in claim 3, wherein said hood member has a second compartment for housing a battery charger for charging the battery and preferably a battery charger is located in the second compartment.

5. The portable water tank assembly as claimed in claim 4, wherein said hood member has a third compartment for housing a spare battery and preferably a spare battery is located in the third compartment.

6. The portable water tank assembly as claimed in claim 1, wherein said hood member includes a handle for carrying the water tank assembly.

7. The portable water tank assembly as claimed in claim 1, wherein the water container has an upwards protruding flange to which the hood member is attached, preferably with screws.

8. The portable water tank assembly as claimed in claim 1, wherein said electronic circuit board includes a timer function for avoiding discharging the battery by mistake and preferably includes a voltage monitor for protecting the battery by avoiding the voltage falling below a predetermined level.

9. The portable water tank assembly as claimed in claim 6, wherein said hood member has a power switch located on the handle for starting and stopping the pump.

10. The portable water tank assembly as claimed in claim 1, further comprising a foot member attached to a bottom portion of the water container.

11. The portable water tank assembly as claimed in claim 10, wherein the water container has a bottom flange, around which the foot member is attached.

12. The portable water tank assembly as claimed in claim 10, wherein the bottom portion and the foot member define a recessed annular space for housing a coiled hose, which in an uncoiled state is intended to connect the water tank assembly to the construction machine.

13. The portable water tank assembly as claimed in claim 12, wherein the hose has a free end provided with a connector having an integrated stop valve.

14. The portable water tank assembly as claimed in claim 13, wherein the hood member has a highly located holder for the free end of the hose.

15. The portable water tank assembly as claimed in claim 1, wherein said low pressure pump is a non self priming pump located close to the bottom of the water container, inside or outside the water container.

16. The portable water tank assembly as claimed in claim 15, wherein said non self priming pump is a centrifugal pump.

17. The portable water tank assembly as claimed in claim 1, wherein said water container has a volume of at most 17 liters, and preferably with a full tank has a maximum weight of at most 20 kg.

18. The portable water tank assembly as claimed in claim 1, wherein the pump is a low pressure pump of 0.3-1.2 bar, submersible and placed inside the water container.

19. The portable water tank as claimed in claim 17, wherein the volume of the water container is about 10 liters and the full tank has a maximum weight of about 14 kg.

* * * * *